US009066188B2

(12) United States Patent
Bern

(10) Patent No.: US 9,066,188 B2
(45) Date of Patent: Jun. 23, 2015

(54) ACOUSTIC TRANSMISSION METHOD AND LISTENING DEVICE

(71) Applicant: Oticon Medical A/S, Smorum (DK)

(72) Inventor: Bengt Bern, Smorum (DK)

(73) Assignee: OTICON MEDICAL A/S, Smorum (DK)

( * ) Notice: Subject to any disclaimer, the term of this patent is extended or adjusted under 35 U.S.C. 154(b) by 0 days.

(21) Appl. No.: 13/662,219

(22) Filed: Oct. 26, 2012

(65) Prior Publication Data

US 2013/0114834 A1 May 9, 2013

Related U.S. Application Data

(60) Provisional application No. 61/556,842, filed on Nov. 8, 2011.

(51) Int. Cl.
*H04R 1/00* (2006.01)
*H04R 25/00* (2006.01)

(52) U.S. Cl.
CPC ..... *H04R 25/606* (2013.01)

(58) Field of Classification Search
CPC ..... H04R 1/00; H04R 25/00; H04R 25/606; H04R 2225/021; H04R 2225/63; H04R 2225/67; H04R 2460/13; A61N 1/36032
USPC ..... 381/151; 600/25
See application file for complete search history.

(56) References Cited

U.S. PATENT DOCUMENTS

| | | | | |
|---|---|---|---|---|
| 4,736,747 | A * | 4/1988 | Drake | 607/61 |
| 5,949,895 | A | 9/1999 | Ball et al. | |
| 7,722,524 | B2 * | 5/2010 | Lupin et al. | 600/25 |
| 7,881,800 | B2 * | 2/2011 | Daly et al. | 607/57 |
| 2003/0031336 | A1 | 2/2003 | Harrison et al. | |
| 2006/0056649 | A1 | 3/2006 | Schumaier | |
| 2007/0053536 | A1 * | 3/2007 | Westerkull | 381/326 |
| 2007/0156011 | A1 | 7/2007 | Westerkull | |
| 2007/0249889 | A1 | 10/2007 | Hanson et al. | |
| 2008/0009918 | A1 | 1/2008 | Zierhofer et al. | |
| 2009/0209806 | A1 | 8/2009 | Hakansson | |

FOREIGN PATENT DOCUMENTS

| | | | |
|---|---|---|---|
| DE | 20 2004 006 117 | U1 | 8/2004 |
| DE | 10 2006 026 288 | A | 1/2007 |
| DK | 56794 | A | 11/1995 |
| EP | 2302953 | A2 | 3/2011 |
| WO | WO 01/93635 | A1 | 12/2001 |
| WO | WO 2010/111547 | A1 | 9/2010 |
| WO | WO 2010/131360 | A1 | 11/2010 |

* cited by examiner

*Primary Examiner* — Davetta W Goins
*Assistant Examiner* — Oyesola C Ojo
(74) *Attorney, Agent, or Firm* — Birch, Stewart, Kolasch & Birch, LLP

(57) ABSTRACT

A listening device having an ear hook adapted for carrying the device behind the ear of a user and magnetically operated compression parts including a subcutaneous part and a device part is provided, where further a vibrator is provided and adapted to vibrationally energize a skin portion through an output coupler, wherein the hook carries the weight of the listening device and the magnetic compression parts ensures compression between the output coupler and the skin portion.

11 Claims, 3 Drawing Sheets

ACOUSTIC TRANSMISSION METHOD AND LISTENING DEVICE

CROSS REFERENCE TO RELATED APPLICATIONS

This nonprovisional application claims the benefit of U.S. Provisional Application No. 61/556,842 filed on Nov. 8, 2011 and to European Patent Application No. 11188206.4 filed on Nov. 8, 2011. The entire contents of all of the above applications are hereby incorporated by reference.

TECHNICAL FIELD

The application relates to an acoustic transmission method and a listening device.

BACKGROUND

It is known to provide vibrations to the skull bone directly or indirectly in order to exitate the cochlear whereby this excitation may be perceived as sound. This is done to provide a sensation of hearing to people who has a functioning cochlear, but have damaged or deformed ear structures.

It is known to provide hearing to these patients by attaching a magnetic means to the skull bone surface under the skin, and then excite the magnetic means with a magnetic field corresponding to a sound signal. Also a magnet provided subcutaneous may serve as an attachment point for a conventional vibrator which will be sitting exteriorly on the skin, attached thereto by the subcutaneous magnet. In both these instances, the skin between magnet and the exterior part may be subject to compression forces, and this may hamper blood circulation in this skin layer and serious negative effects such as irritation and necrosis may result from this.

Yet a further prior art example is to attach a vibrational transducer subcutaneously to the skull bone or cochlear and to energize the transducer by means of an electromagnetic signal provided by an externally mounted apparatus. In this kind of apparatus, a transcutaneous transmission of both energy and signal is necessary from the device on the outside to the transducer placed at the cochlear or under the skin, and a coil or similar device is needed to receive the energy and information signal.

In a prior art device disclosed in U.S. Pat. No. 5,176,620 the transducer is provided under the skin behind the ear, and an acoustic wave guide is provided between the transducer and the cochlea. In this way, the skull bone is not used as transmission path, and the transducer may be made smaller and may consume less energy in order to vibrationally excite the cochlea. However, in this prior art device the power signal is still to be transmitted through the skin as an electromagnetic signal, and a complicated transducer with a multitude of electronic components must be provided in or at the skull bone.

SUMMARY

A listening device is provided which has an ear hook adapted for carrying the device behind the ear of a user. The listening device has magnetically operated compression parts including subcutaneous parts and device parts, where further a vibrator is provided as part of the listening device and adapted to vibrationally energize a skin portion through an output coupler, wherein the ear hook carries the weight of the listening device and the magnetic compression parts ensures compression between the output coupler and the skin portion.

Instead of having strong magnets to hold the hearing aid system in place as is known in the prior art the proposed invention uses a hook around and above the ear to hold the hearing aid system in place. The hook is similar to hooks used in usual hearing aid systems for delivering a sound signal into the ear canal of the user. A system of magnetically operated parts are provided to compress the skin in order to make a good vibration transfer through the skin, but this new magnet system will need to generate a much smaller magnetic force than the magnet systems of prior art devices which needs to both carry the weight of a vibrator and ensure sufficient compression of the skin portion which is to receive the vibrations. Therefore skin irritation and the possible risk of necrosis can be avoided with the new system.

Because the magnet system can be made much weaker, due to the absence of a need for holding or carrying forces, the pressure on the skin will be smaller and therefore a relatively large area is not needed to distribute the holding force over the skin. The skin area, under which a magnetic device is present, can be made smaller and the risk of feedback will also be reduced.

A system with a capsulated magnet that is just positioned in a small drilled recess in the skull bone is proposed. This implant is easy to surgically put in place without need for special surgical instrumentation. The implant can be removed easily in case a MRI scan of the user is needed.

It is further proposed to screw the capsulated magnets into the skull bone with osseointegration between threads of a capsulated magnet and skull bone.

The placement of the hearing aid closer to the ear canal also puts it closer to the cochlea with larger sensitivity as a result. This is possible because of the hook used for carrying the heavy vibrator and other parts of the hearing aid.

The hook also makes it possible to position the microphones in the hook as is known from a traditional BTE hearing aid. This facilitates a more favorable position of the hearing aid microphone as placement thereof in front of the ear of the user helps in generating a more natural directionality and sound, than what can be obtained with the traditional bone anchored hearing aid systems where the entire apparatus is mounted on the head behind the ear, and further to the back of the head.

It is intended that the structural features of the device described above, in the 'detailed description of embodiments' and in the claims can be combined with the method, when appropriately substituted by a corresponding process and vice versa. Embodiments of the method have the same advantages as the corresponding devices.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference numerals are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

In the following examples, the listening device is provided in the shape of a hearing aid adapted to be worn by individuals with reduced hearing. Other listening or communication devices such as headsets or radio communication devices may however also benefit from the general idea of the invention.

Figure 1:
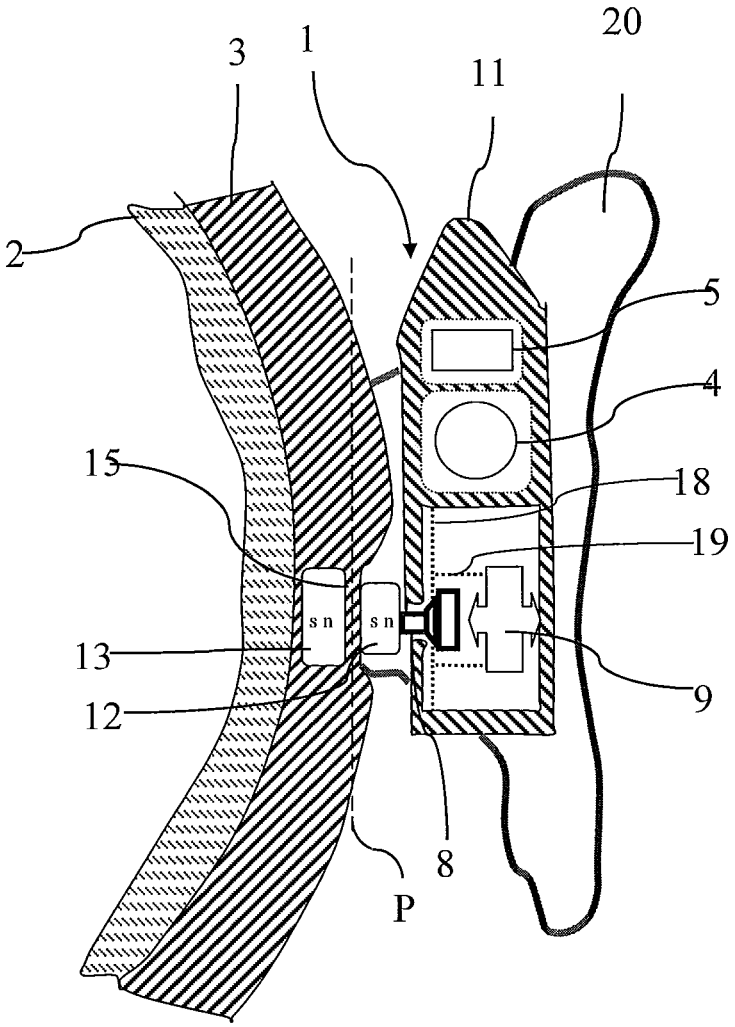
FIG. 1 shows a schematic hearing aid according.

The listening device 1 in FIG. 1 includes an ear hook 11 and magnetically operated compression parts 12,13 with a subcutaneous compression part 13 and a device compression part 12 forming part of the listening device 1. The two compression parts 12,13 are arranged to provide an attraction force between each other, when they are close to each other, such as by the one part being a permanent magnet and the other part an iron part, or by both parts including permanent magnet elements. The compression parts 12,13 may be titanium encapsulated samarium cobalt magnets. The compression part 13 provided subcutaneous may be fastened to the skull bone 2 underneath the skin 3 by suitable means such one or more screws, by suture or it may be provided in a recess formed in the skull bone for this purpose as is known in the art. The skull bone recess may also be threaded to allow the compression part to be screwed into the bone without the use of additional parts such as loose screws. Further, a vibrator 9 is provided and adapted to vibrationally energize a skin portion 15 through an output coupler 8. The output coupler 8 and the vibrator 9 are well known elements in bone conduction hearing aids and are thus not described in much further detail. The vibrator 9 is suspended from springs 18, and a further spring 19 is provided maintaining a distance between the vibrator 9 and the output coupler 8 as is known in the art. The output coupler 8 is coupled at its output end to the magnetic means 12 which serves to attract the subcutaneous magnetic part 13, when the hearing aid is set on the ear 20. The hearing aid 1 further includes a hook 11, which in use hooks over the top part of the connection between outer ear 20 and the side of the users head. In this way the hook 11 carries the weight of the listening device and the magnetic compression parts 12,13 ensures compression between the output coupler 8 and the said skin portion 15.

The output coupler 8 and the compression part 12 in the listening device 1 may be provided adjacent to each other, or as shown on top of each other. There are however many other ways of arranging these parts, and a further option is to integrate the compression part 12 into the output coupler.

The subcutaneous magnetic compression part 13 may cover an area which is larger than the area covered by the compression part 12 of the listening device. The area in question is best measured as the projection of the area of the compression parts onto a plane P between the two compression parts 12,13 whereby the plane P is oriented to extend perpendicular to the magnetic field lines between the respective compression parts 12,13 when the listening device is placed to operate on an individual.

Figure 3:
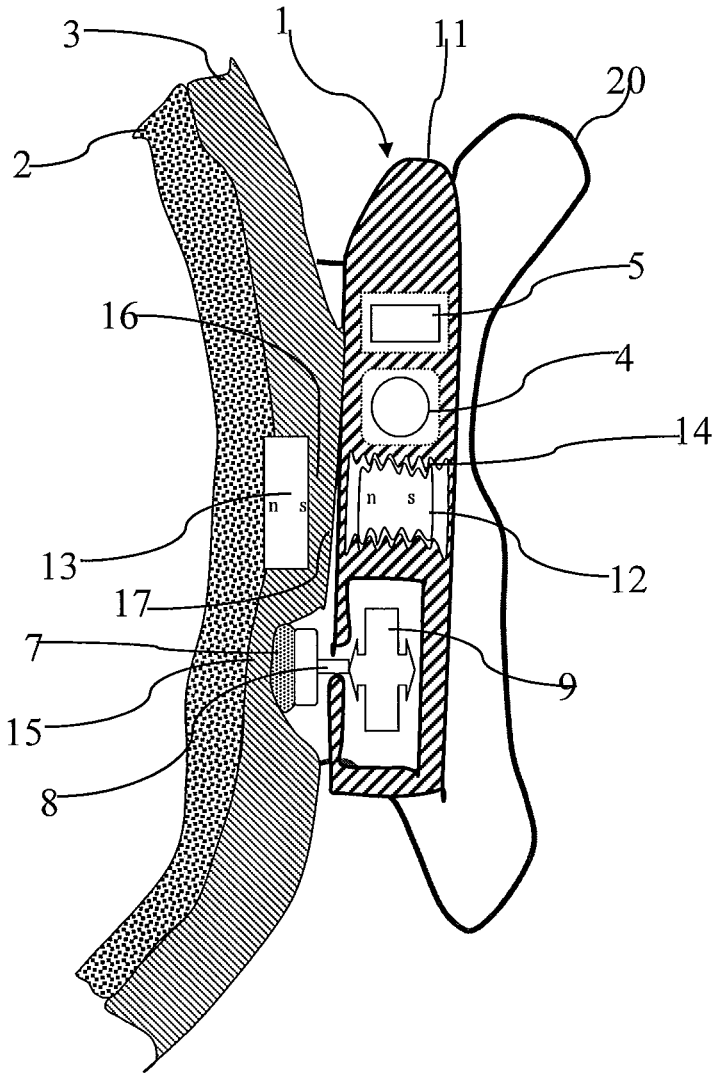
FIG. 3 is a schematic drawing of a hearing aid according to the invention.

In FIG. 3 a different example of the hearing aid is shown, wherein the distance between the skin surface 17 and the compression part 12 within the listening device 1 is adjustable. This is possible in that the compression part 12 is a threaded cylindrical part mounted within a threaded house 14. By turning the compression part 12 it will move towards or away from the subcutaneous compression part 13 and skin surface 17, and the compression forces acting on the skin 15 below the output coupler 8 will become smaller or larger accordingly.

In the embodiment shown in FIG. 3 also the output coupler 8 is connected to an adapter 7. The adapter has a shape matching the skin and underlying bone at this particular point of the users head, such that deformities or a singular shaped skull of the user at this place may be taken into account.

Figure 2:
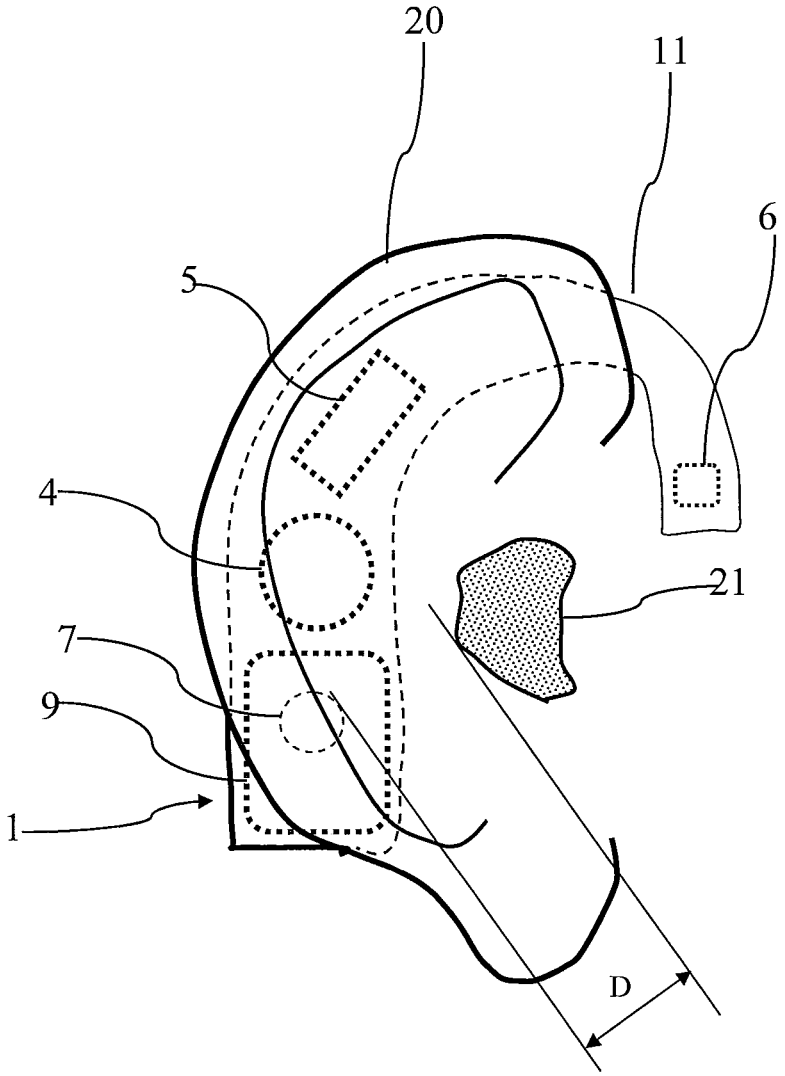
FIG. 2 shows the hearing aid of FIG. 1 seen in a sideview.

The listening device includes as seen in FIGS. 2 and 3 a battery 4, a signal processor 5 and a microphone 6, and as is usual in the art these components are interconnected by suitable electric leads. An array of microphones may be included in the device, and also wireless capability allowing the device to obtain audio signals from a remote point is possible. Further, a direct audio input or DAI connection may be part of the device.

As seen in FIG. 2 the output coupler 8 is provided a distance D from the ear canal 21 behind the ear of the user. It is attempted to keep this distance below 30 mm and preferably below 25 mm and most preferably below 20 mm. By keeping this distance small, the vibrations shall travel a shorter route from the adapter 7 and to the cochlear of the user where the vibrations will be perceived as sound.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

The invention claimed is:

1. A listening device, comprising:

magnetically operated compression parts including a subcutaneous magnetically operated compression part and an external magnetically operated compression part; and a vibrator adapted to vibrationally energize a skin portion through an output coupler, wherein the magnetically operated compression parts ensure compression between the output coupler and the skin portion, the external magnetically operated compression part is spatially separated from the output coupler, and the output coupler is connected to an adapter having a shape that matches skin and underlying bone at a contact surface of the head of a user.

2. The listening device as claimed in claim 1, further comprising:

an ear hook configured to carry the listening device behind an ear of the user.

3. The listening device as claimed in claim 2, wherein the subcutaneous magnetically operated compression part covers an area which is larger than the area covered by the external magnetically operated compression part within the listening device where said area is measured in a plane between the two magnetically operated compression parts and said plane is oriented to extend perpendicular to magnetic field lines between the respective magnetically operated compression parts when the listening device is placed to operate on an individual.

4. The listening device as claimed in claim 3, wherein a distance between a skin surface over the subcutaneous magnetically operated compression part and the external magnetically operated compression part within the listening device is adjustable.

5. The listening device as claimed in claim 3, further comprising:

a battery;

a signal processor; and a microphone.

6. The listening device as claimed in claim 5, wherein the output coupler is provided less than 30 mm from the ear canal of the user in an area behind the outer ear of the user when the listening device is arranged to function at the ear of the user.

7. An acoustic transmission method, comprising:

suspending a vibrator from an ear of a user, the vibrator being adapted to provide a vibrational signal to a skin portion through an output coupler;

generating attraction forces between a subcutaneous magnetically operated compression part and an external magnetically operated compression part, the external magnetically operated compression part being spatially separated from the output coupler of the vibrator;

subjecting the skin portion being adjacent to the ear canal of the user to compression forces generated by the magnetically operated compression parts; and transmitting a vibrational signal from the suspended vibrator and into the skin portion and into the skull bone beneath the skin portion through the output coupler connected to an adapter having a shape that matches the shape of the skin portion and underlying bone under the skin portion.

8. The acoustic transmission method as claimed in claim 7, further comprising:

adjusting a distance between a surface of the skin portion and the external magnetically operated compression part.

9. The acoustic transmission method as claimed in claim 7 or 8, further comprising:

capturing a sound by a microphone;

enhancing the captured sound by a signal processing device; and serving the enhanced captured sound at the vibrator and transducing into mechanical vibration by the vibrator.

10. The listening device as claimed in claim 6, wherein the output coupler is provided less than 25 mm from the ear canal of the user in the area behind the outer ear of the user when the listening device is arranged to function at the ear of the user.

11. The listening device as claimed in claim 10, wherein the output coupler is provided less than 20 mm from the ear canal of the user in the area behind the outer ear of the user when the listening device is arranged to function at the ear of the user.

* * * * *

UNITED STATES PATENT AND TRADEMARK OFFICE

CERTIFICATE OF CORRECTION

PATENT NO. : 9,066,188 B2
APPLICATION NO. : 13/662219
DATED : June 23, 2015
INVENTOR(S) : Bengt Bern It is certified that error appears in the above-identified patent and that said Letters Patent is hereby corrected as shown below:

ON THE TITLE PAGE:

Please insert the following:

-- (30) Foreign Application Priority Data

Nov. 8, 2011 (EP) ……. 11188206.4 --.

Signed and Sealed this
Eighth Day of December, 2015

Michelle K. Lee

Michelle K. Lee
*Director of the United States Patent and Trademark Office*